United States Patent [19]

Foster

[11] Patent Number: 5,065,686

[45] Date of Patent: Nov. 19, 1991

[54] SAIL BATTEN COMPRESSION ADJUSTMENT FITTING

[76] Inventor: Lewis R. Foster, 112 Bond Ct., Los Gatos, Calif. 95302

[21] Appl. No.: 659,086

[22] Filed: Feb. 22, 1991

[51] Int. Cl.[5] ..... B63H 9/06

[52] U.S. Cl. ..... 114/103; 114/102

[58] Field of Search ..... 114/103, 102, 107, 39.1; 248/188.4

[56] References Cited

U.S. PATENT DOCUMENTS

| | | | |
|---|---|---|---|
| 4,602,585 | 7/1986 | Hackney | 114/103 |
| 4,823,720 | 4/1989 | Foster | 114/98 |
| 5,012,755 | 5/1991 | Lockhart et al. | 114/103 |

OTHER PUBLICATIONS

Technical Drawing of Series 300 Batten Car from LEWMAR dated 1/25/91.

Mainsail Slides, Sail Fittings and Batten Pockets, Product Brochure from RONDAL, Marine Hardware, p. 22, date unknown.

"News from Bainbridge/Aquabatten"; Round Batten Compression Fittings by SDA, 6/90.

Drawing of Batten Tensioner Attached to Frederiksen Car Part. No. S103S, SWL 1475 KG, BL 2950 KG, date unknown.

"Pressure-Absorbing Slides Designed for Use With Full Length Battens"; Product Brochure from Harken, date unknown.

*Primary Examiner*—Ed Swinehart

*Attorney, Agent, or Firm*—Burns, Doane, Swecker & Mathis

[57] ABSTRACT

A batten compression adjustment fitting for use in adjusting the compression of a batten in the sail of a sailboat includes a housing having a batten receptacle that is adapted to receive a batten and a compression adjustment assembly receptacle that is adapted to receive a compression adjustment assembly. The compression adjustment assembly includes an adjustment screw, a traveler that encircles and is freely movable along the adjustment screw and a lock nut that threadably engages the adjustment screw. The traveler has a batten contacting portion that extends into the batten receptacle so as to contact the batten. Upon appropriate operation of the adjustment screw, the lock nut moves along the adjustment screw, thereby causing the traveler to also move and apply a compressive force, via the batten contacting portion, to the batten positioned in the batten receptacle.

23 Claims, 3 Drawing Sheets

SAIL BATTEN COMPRESSION ADJUSTMENT FITTING

FIELD OF THE INVENTION

The present invention pertains to compression adjustment fittings and more particularly, to sail batten compression adjustment fittings for adjusting the compression of a batten in a sail, especially full-length batten sails.

BACKGROUND OF THE INVENTION

Battens have been used or sailboats for quite some time in order to control various characteristics of the sail. Typically, the batten is a strip of flexible material (e.g., wood, plastic, fiberglass) that fits into a pocket sewn onto the sail. In one respect, the battens are quite useful in that they help prevent the leech of the sail from curling over. As a result, the sail is prevented from flogging or luffing in the wind, thereby increasing the life of the sail. Moreover, the presence of battens in the sail makes it much easier to stack the sail on the boom when it is lowered.

Full-length batten sails (i.e., sails employing battens that extend across substantially the entire length of the sail from the leech end to the luff end) have become quite popular, and in an attempt to improve the performance characteristics and operation of sailboats employing full-length batten sails, various types of devices which are adapted to be attached to the sail have been proposed. Of particular concern here are devices that permit the compression of the batten to be adjusted.

Devices that allow the compression in the battens to be adjusted are potentially useful on many types of sailboats, including racing sailboats, as well as cruising sailboats, and large sailboats, as well as small sailboats. Devices for adjusting the compression in sail battens are useful in any wind condition because they permit the desired amount of curvature to be imparted to the sail and they remove unwanted wrinkling of the sail cloth, especially along the batten pockets. As is known, being able to provide curvature in the sail during light wind conditions allows one to take advantage of and effectively utilize whatever wind may be present. It can be seen, therefore, that by providing a device for adjusting the compression in the sail battens, the sailboat can be fine-tuned to the prevailing weather conditions.

Various types of devices are currently available for effecting changes in the compression of sail battens. However, many of them suffer from one or more drawbacks or disadvantages. For example, it is not uncommon to find sailboats that employ battens having different shapes (i.e., different cross-sectional shapes) such as circular battens, square battens and generally flat battens. Unfortunately, many of the compression adjusting devices currently available are designed to be used in conjunction with sails employing a batten having one particular shape. The use of such devices is limited, therefore, to the extent that they cannot be employed in conjunction with sails that have been outfitted with battens which are of a different shape.

Another drawback associated with many of the prior art compression adjusting devices relates to their inability to be readily and easily adjusted while under sail. In order to maximize the performance of a sailboat, the compression of the battens and the resulting curvature in the sail should be capable of being quickly adjusted in response to changes in sail cloth distortion and wind conditions. If the compression in the sail batten cannot be altered while under sail or can be altered only with much effort, obtaining full performance from the sailboat will be quite difficult.

SUMMARY OF THE PRESENT INVENTION

The foregoing drawbacks and disadvantages, as well as others, have been addressed and overcome by the sail batten compression adjustment fitting according to the present invention. In accordance with a preferred embodiment, the compression adjustment fitting includes a housing having a batten receptacle that is adapted to receive a batten, and a compression adjustment assembly receptacle that is adapted to receive a compression adjustment assembly. The fitting further includes a compression adjustment assembly capable of being positioned in the compression adjustment assembly receptacle for adjusting the compression in a batten positioned in the batten receptacle. The batten receptacle preferably opens to one side of the housing so that the batten can be positioned close to the surface of the sail.

Preferably, the housing is substantially symmetrical about a plane which passes through a longitudinal midpoint of the housing and which is substantially perpendicular to the open side of the housing. Also, the batten receptacle and the compression adjustment assembly receptacle are preferably positioned above one another when the fitting is mounted on a vertically positioned sail.

In accordance with a preferred embodiment, the compression adjustment assembly includes an adjustment screw positioned in the compression adjustment assembly receptacle so that its head is accessible from the exterior for purposes of adjustment. A lock nut is adapted to threadably engage the adjustment screw but is prevented from rotating due to the shape of the compression adjustment assembly receptacle. A tubular traveler is adapted to encircle and move freely along the adjustment screw. The traveler is positioned between the lock nut and the head of the adjustment screw and has an upstanding batten contacting portion extending therefrom that is adapted to extend into the batten receptacle in order to contact a batten positioned therein. Upon rotation of the adjustment screw, the lock nut is forced to move axially along the adjustment screw, thereby causing the traveler and the batten contacting portion to move and apply a compressive force to the batten.

A backing plate is adapted to be connected to the housing with a portion of the sail positioned therebetween. The backing plate can be in the form of a flat plate, in which case the batten is positioned substantially on the center line of the mast with the sail slightly offset from the center line. Alternatively, the backing plate can be provided with an arcuate recess adjacent one end thereof for receiving the bolt rope of the sail. In this latter case, the sail is substantially aligned with the center line of the boat while the batten is slightly offset from the center line.

BRIEF DESCRIPTION OF THE DRAWING

The features of the sail batten compression adjustment fitting according to the preferred embodiments of the present invention and the advantages associated with the sail batten compression adjustment fitting according to the preferred embodiments of the present invention will become apparent from the description that follows, considered in conjunction with the accompanying drawing figures in which like elements bear like reference numerals and wherein.

DETAILED DESCRIPTION OF THE PREFERRED EMBODIMENTS

Figure 4:
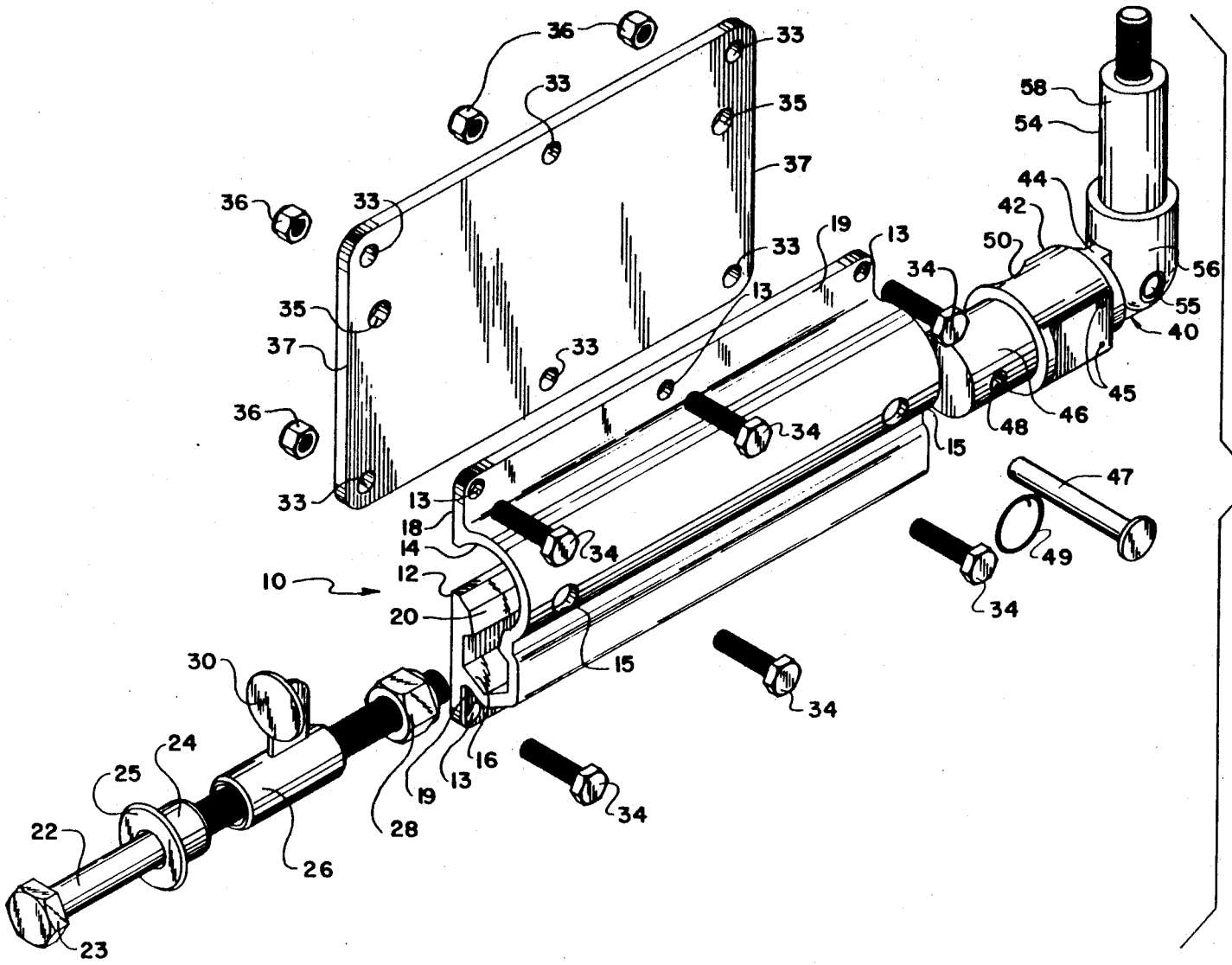
FIG. 4 is an exploded perspective view of the fitting according to a preferred embodiment of the present invention.

Looking first at FIG. 4, which illustrates the various features of the batten compression adjustment fitting 10 according to one embodiment of the present invention, a housing 12 is provided with a batten receptacle 14 and a compression adjustment assembly receptacle 14. Both receptacles 14, 16 extend the entire length of the housing 12 and open at opposite ends of the housing 12. The batten receptacle 14 also opens to one side 18 of the housing 12. The side 18 of the housing 12 to which the batten receptacle 14 opens is substantially planar so as to be positioned flat against a sail. The side 18 of the housing defines two attachment flanges 19 which are provided with through holes 13.

The compression adjustment assembly receptacle 16 is adapted to receive a compression adjustment assembly which will be described in more detail below. Also, the batten receptacle 14 is adapted to receive a batten.

The compression adjustment assembly receptacle 16 is connected to the batten receptacle 14 along its length by way of an interconnecting passage 20. Preferably, the batter receptacle 14 and the compression adjustment assembly receptacle 16 extend substantially parallel to one another and are positioned above one another. In particular, when the fitting 10 is mounted on a sail in the manner that will be described in more detail below, the batten receptacle 14 is positioned above the compression adjustment assembly receptacle 16.

The housing 12 is also provided with two holes 15 which are spaced equidistant from their respective ends of the housing 12. The purpose of the holes 15 will become apparent from the description below.

It can be readily seen from the foregoing description as well as from a review of FIG. 4 that the housing 12 is substantially symmetrical about a plane that contains the longitudinal midpoint of the housing 12 (i.e., the point midway between opposite ends of the housing 12), and that is substantially perpendicular to the one side 18 of the housing 12.

The compression adjustment assembly that is adapted to be positioned in the compression adjustment assembly receptacle 16 includes an adjustment screw 22, a tubular flanged ferrule 24, a tubular traveler 26, and a lock nut 28. The adjustment screw 22 is positioned in the compression adjustment assembly receptacle 16 and the head 23 of the adjustment screw 22 is maintained outside the housing 12 for adjustment purposes by way of the flanged ferrule 24. The flanged ferrule 24 encircles the adjustment screw 22 so that the enlarged head 23 of the adjustment screw 22 abuts the flange 25 on the ferrule 24. The flange 25 of the ferrule 24 abuts against the end of the housing 12.

The lock nut 28 is adapted to threadably engage the threaded portion of the adjustment screw 22. When the entire compression adjustment assembly is positioned in its receptacle 16, the lock nut 28 is located in the receptacle 16 and is prevented from rotating due to the cross-sectional shape of the receptacle 16. In a preferred embodiment, the receptacle 16 possesses a hexagonal cross-sectional shape to match the hexagonal shape of the lock nut 28. It is to be understood, however, that if a lock nut having a shape different from that illustrated in FIG. 4 is employed, the receptacle 16 can have a corresponding cross-sectional shape. Moreover, it should be realized that the cross-sectional shape of the receptacle 16 and the lock nut 28 need not be the same, so long as the lock nut is prevented from rotating.

Because the lock nut 28 is prevented from rotating, upon rotational movement of the adjustment screw 22, the lock nut 28 moves longitudinally along the screw 22 and axially within the receptacle 16.

The tubular traveler 26 is adapted to encircle and freely move along the adjustment screw 22. The tubular traveler 26 includes an integrally formed upstanding batten contacting portion 30. The upstanding batten contacting portion 30 is adapted to extend through the interconnecting passage 20 and into the batten receptacle 14 in order to contact the end surface of a batten positioned in the batten receptacle 14.

The traveler 26 is positioned between the lock nut 28 and the head 23 of the adjustment screw 22. When the adjustment screw 22 is rotated in the appropriate direction, the lock nut 28 is caused to move toward the head 23 of the screw 22, thereby causing the traveler 26 to move in a similar direction. As a result, a compressive force can be applied to the batten positioned in the batten receptacle 14.

The fitting 10 further includes a backing plate 32 that is adapted to be connected to the housing 12. The backing plate 32 is provided with through holes 33 that are adapted to be aligned with the holes 13 in the housing 12 when the backing plate 32 and the housing 12 are positioned on opposite sides of the sail. The aligned holes 13, 33 permit the backing plate 32 and the housing 12 to be connected to one another by any suitable means, such as bolts 34 and nuts 36. Of course, the backing plate 32 and the housing 12 could be connected to one another by other appropriate means.

The backing plate 32 also includes two other through holes 35 that are spaced equidistant from the respective ends 37 of the backing plate 32. The through holes 35 are adapted to be aligned with the holes 15 in the housing 12 when the backing plate 32 is mounted on the housing 12.

The fitting 10 further includes a joint member 40 and a slide member 60 (see FIG. 1) for connecting the housing 12, the backing plate 32 attached thereto and the compression adjustment assembly located in the housing 12 to the mast of the sailboat. The joint member 40 and the slide member 60 can be similar to the joint member and the slide member disclosed in the inventor's prior patent, U.S. Pat. No. 4,823,720.

The joint member 40 can include a link holder 42 that is pivotally connected to a link 54. The link holder 42 is rotatably connected to eye portion 44 and includes a cylindrical portion 46 (see U.S. Pat. No. 4,823,720). Link holder 42 has a bore therein which receives the cylindrical end of eye portion 44. The cylindrical end has a circumferential groove (not seen) which allows the cylindrical end to be axially secured by pins 45 and still allow rotation of eye portion 44 with respect to link holder 42. The cylindrical portion 46 is sized and configured to be fitted into either end of the batten receptacle 14. The cylindrical portion 46 also has a hole 48 extending therethrough that is adapted to be aligned with either of the holes 15 in the housing 12 and either of the holes 35 in the backing plate 32. Once the backing plate 32 has been secured to the housing 12, the cylindrical portion 46 of the link holder 42 can be inserted into the appropriate end of the batten receptacle 14 and secured in place relative to the housing 12 and the backing plate 32 by inserting a clevis pin 47 through the aligned holes 15, 35, 48. To prevent the pin 47 from being removed, a cotter ring 49 can be positioned on the pin 47.

Figure 1:
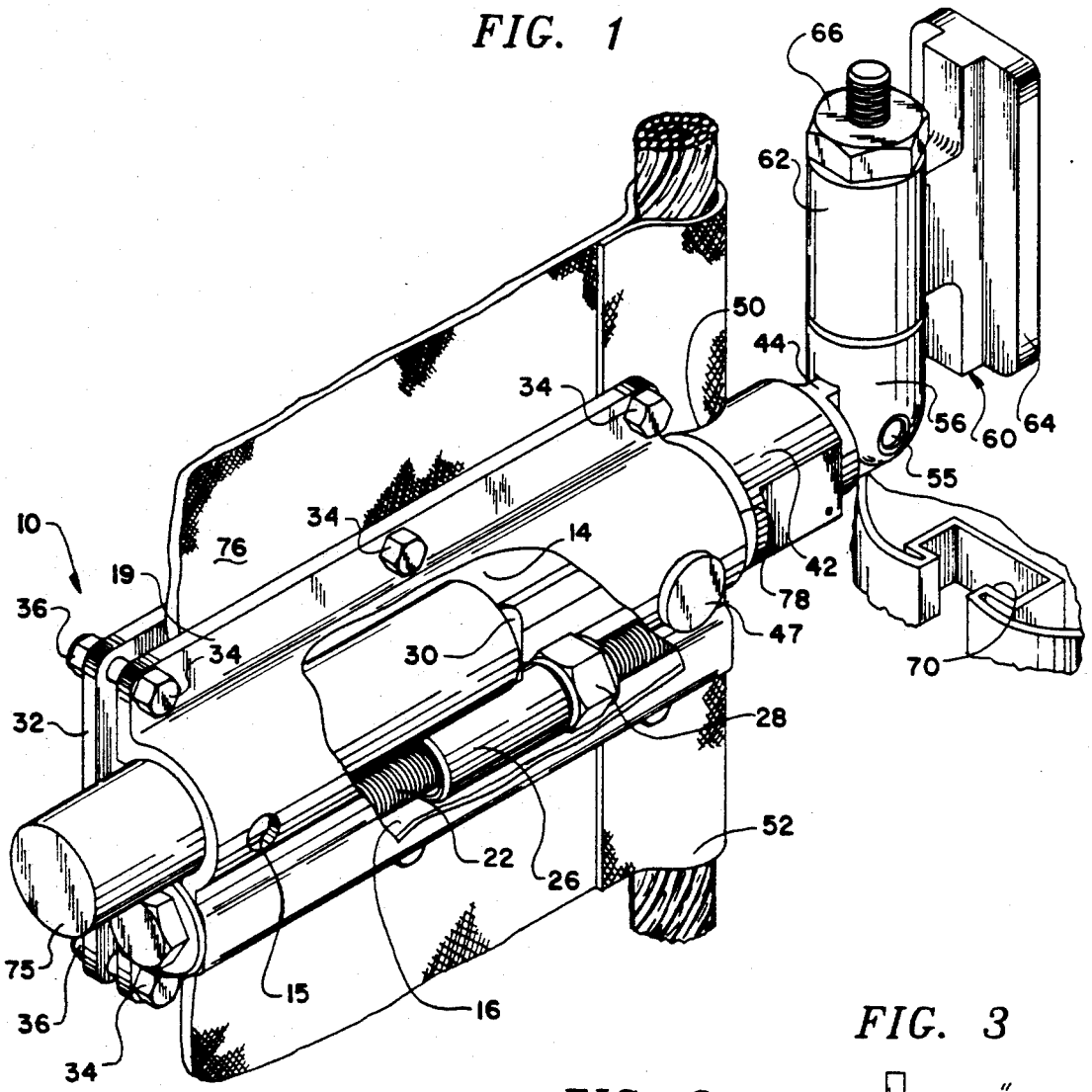
FIG. 1 is a perspective view of the batten compression adjustment fitting according to a preferred embodiment of the present invention attached to a sail.

An arcuate recess 50 is formed in one side of the cylindrical portion 46 of the link holder 42 for receiving the bolt rope 52 (see FIG. 1).

The articulating link 54 can be comprised of a fork portion 56 and an axle portion 58. To connect the fork portion 56 of the link 54 to the eye portion 44 of the link holder 42, a pin 55 is provided.

As seen in FIG. 1, the slide member 60 includes a tubular bearing section 62 and a slide portion 64. The bearing section 62 encircles the axle portion 58 of the link 54 and rests upon the fork portion 56. Suitable bearings can be provided between the axle portion 58 of the link 54 and the tubular bearing section 62 to facilitate rotational movement between the two parts and thereby permit the slide member 60 to rotate relative to the axis of the axle portion 58. The bearing section 62 and the slide portion 64 are preferably formed integrally with one another. To inhibit the slide member 60 from moving axially off the axle portion 58, a nut 66 is provided. The nut 66 is adapted to threadably engage the upper threaded section of the axle portion 58.

The slide portion 64 is adapted to slide into the guide track 70 of the mast, and thus the guide track 70 is shaped to receive the slide portion 64. However, it should be recognized that the shape of the slide portion 64 can be varied, depending upon the shape of the guide track 70 in the mast.

The joint member 40 and the slide member 60 described above are advantageous in that they permit the batten to move in three axes relative to the mast. That is, the slide number 60 is able to pivot about the axis of the axle portion 58, the link 54 is able to pivot about the axis of the pin 55 and the eye portion 44 is able to pivot about the longitudinal axis of the link holder 42. Additional advantages are discussed in the aforementioned prior patent of the inventor.

Figure 2:
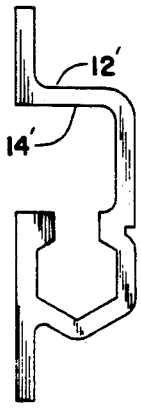
FIG. 2 is a cross-sectional view of an alternative configuration of the housing which forms a part of the fitting.
Figure 3:
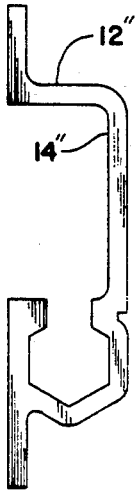
FIG. 3 is a cross-sectional view similar to FIG. 2 illustrating another configuration for the housing.

As can be seen from FIGS. 1 and 4, batten receptacle 14 is generally circular in cross-sectional shape, thereby being adapted to receive a circular batten (i.e., a batten having a circular cross-section). However, as seen in FIGS. 2 and 3, the housing can be configured to receive battens having shapes other than circular. For example, as 10 depicted in FIG. 2, the housing 12' can be fabricated such that the batten receptacle 14' is able to receive square battens. Similarly, as seen in FIG. 3, the housing 12" can be configured such that the batten receptacle 14" is able to receive flat, generally rectangular battens. In this latter case, the cross-sectional shape of the batten receptacle 14" is generally rectangular with two sides being larger than the other two sides. The batten receptacle can be configured to have a cross-sectional shape different from those shown in the drawing figures, if necessary, to accommodate differently shaped battens.

It can be seen, therefore, that by simply modifying the shape of the batten receptacle, the fitting 10 can be easily adapted to receive differently shaped battens. Of course, it may also be necessary to design the cylindrical portion 46 of the link holder 42 to correspond in cross-sectional shape to the cross-sectional shape of the batten receptacle. Thus, by manufacturing housings 12 which have cross-sectional shapes to match the variously shaped battens (and possibly manufacturing link holders which can be received in the differently shaped batten receptacles), any type of boat using any shape of sail batten can be outfitted with a fitting according to the present invention. It is not necessary to modify the compression adjustment assembly in any way nor is it necessary to modify the backing plate.

The fitting 10 according to the present invention can be mounted on either side (i.e., the port side or the starboard side) of the sail depending upon the location of the batten. Also, the fitting 10 can be mounted on the luff or leech end of the sail. FIG. 1 shows the fitting 10 mounted on the starboard side of the sail 76 and at the luff end. To mount the fitting 10 on the port side of the sail, it would only be necessary to remove the compression adjustment assembly from its receptacle 16, insert it into the opposite end of the receptacle 16 and then insert the cylindrical portion 46 of the link holder 42 into the opposite end of the batten receptacle 14. That is the reason why the housing 12 is provided with through holes 15 at both ends and why the backing plate 32 is similarly provided with through holes 35 at both ends.

The ability of the fitting to be mounted on either side of the sail 76 and the ease with which the alternative mounting can be accomplished are due, at least in part, to the symmetrical nature of the housing 12 which was mentioned above. Thus, the versatility and usefulness of the fitting according to the present invention is not limited to use in conjunction with only port side mounted battens or starboard side mounted battens. Moreover, the fitting 10 of the present invention does not require modifications of any sort to achieve that functionality and versatility.

After determining the correct side of the sail on which the housing 12 is to be positioned and assuming the housing 12 is to be mounted as shown in FIG. 1, holes must be punched in the sail 76 through which the bolts 34 and the pin 47 can pass. To do this, the housing 12 is aligned with a batten pocket and the bolt rope on the sail is positioned in the arcuate recess 50 in the link holder 42. After forming the holes in the sail 76, the backing plate 32 is connected to the housing 12, with the sail 76 positioned therebetween, through use of the nuts 36 and bolts 34. Preferably, the bolts 34 should be tightened against the backing plate 32 while the nuts 36 are in contact with the housing 12.

Once the fitting 10 is properly mounted on the sail 76, it is necessary to fit and size the batten so as to be operable in conjunction with the compression adjusting assembly. In order to do this, the adjusting screw 22 is loosened and removed from the receptacle 16, thereby permitting the lock nut 28 and the traveler 26 to also be removed from the receptacle 16.

The batten is then inserted into the forward end 78 (see FIG. 1) of the batten receptacle 14 and is pushed as far aft into the leech end of the batten pocket as possible. A suitable mark (i.e., a pencil mark) can then be placed on the batten adjacent the forward end 78 of the batten receptacle 14. The batten should then be cut approximately one inch aft of the mark (so that the length of the batten is shorter than the length defined by the mark) in order to afford sufficient room for the batten contacting portion 30 of the traveler 26 as well as the cylindrical portion 46 of the joint member 40.

It may be desirable to round the aft end of the batten prior to inserting the batten into the batten receptacle and the pocket. Also, if the outer diameter of the batten is smaller than the inner diameter of the batten receptacle 14, a situation not uncommon since the upper battens on a sail are oftentimes smaller in diameter than the lower battens, it may be necessary to encase the batten in one or more sleeves of plastic or other material in order to conform the outer diameter of the batten to the inner diameter of the batten receptacle 14.

After the batten has been appropriately sized and reinstalled in the batten receptacle 14, the flanged ferrule 24, the adjustment screw 22, the traveler 26 and the lock nut 28 are inserted once again into the receptacle 16. The adjustment screw 22 should then be operated so as to move the traveler 26 away from the mast (i.e., to the left as seen in FIG. 1). That will permit the cylindrical portion 46 of the link holder 42 to be positioned in the forward end 78 of the housing 12 such that the hole 48 in the cylindrical portion 46 of the link holder 42 is aligned with the hole 15 in the housing 12 and the hole 35 in the backing plate 32. Once the holes 48, 15, 35 are aligned, the clevis pin 47 can be inserted and appropriately secured by the cotter ring 49. Although not specifically depicted in the drawing figures, it will be noted that the pin 47 passes through the open side of the housing 12, and thus there is no need for oppositely positioned holes in the housing 12.

Figure 7:
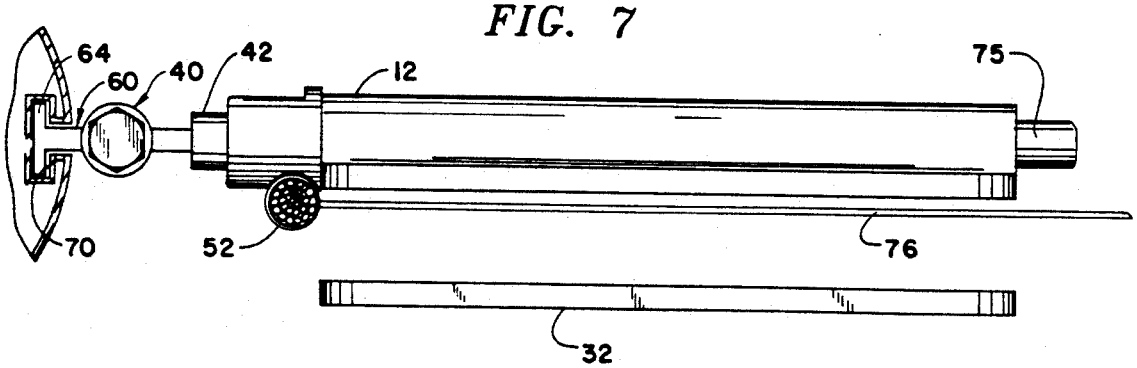
FIG. 7 is a top view depicting another possible way in which the fitting can be mounted to a mast.

Looking at FIG. 7, which illustrates the housing 12 mounted in the guide track 70 of the mast by way of the joint member 40 and the slide member 60, it can be seen that the compression adjustment fitting according to an embodiment of the present invention described above is configured in such a manner that the batten 75 is substantially aligned with the center line of the mast whereas the sail 76 is slightly offset to one side of the center line of the mast. It has been found that as a result of the particular construction, dimensions, and relationships between the various features of the housing 12, the sail is offset from the center line of the boat by approximately 10 mm.

In contrast to the arrangement illustrated in FIG. 7, it may be desirable in some instances to have the sail 76 mounted on the center line of the boat with the batten 75 offset a slight distance from the center line. Such an arrangement might be advantageous, for example, in the case of a sailboat equipped with a wing mast. In such a situation, by simply providing a slightly differently shaped backing plate 80 such as illustrated in FIG. 5, the sail 76 can be substantially aligned with the center line of the boat.

Figure 5:
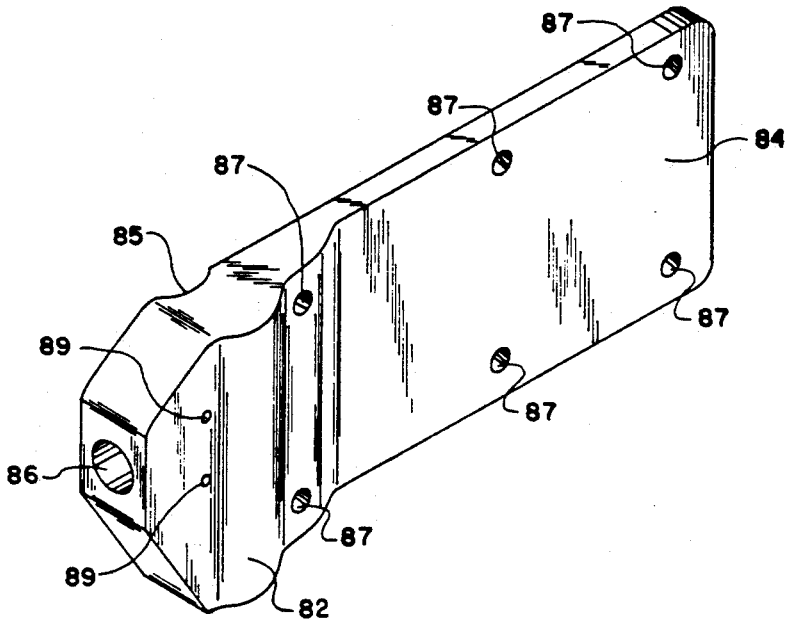
FIG. 5 is a perspective view of a different embodiment of the backing plate that is adapted to be attached to the housing of the fitting.

The backing plate 80 shown in FIG. 5 includes a plate that is substantially flat and planar along a portion 84 of its length. One end of the plate 80 includes a portion 82 that curves slightly outwardly out of the plane of the planar portion 84 of the plate 80. An arcuate recess 85 is provided in the somewhat curved portion 84 of the plate 80. The arcuate recess 85, as will become apparent from the description below is adapted to receive the bolt rope of the sail. A through hole 86 is provided at the one end of the plate 80 in order to permit the eye portion 44 of an articulating link to be inserted therein. The eye portion 44 can be similar to the eye portion described above and shown in FIG. 4.

Additionally, the backing plate 80 includes a plurality of through holes 87 for securing the backing plate 80 to the housing 12. The holes 87 are positioned so as to be aligned with the holes 13 in the flanges 19 of the housing 12, whereby the bolts 34 can extend through the aligned holes 87, 13. To secure the joint member 40 to the backing plate, several holes 89 are provided in the backing plate 80. Pins or the like can be positioned in the holes 89 to straddle the cylindrical portion of the joint member 40 and to secure and maintain it within the hole 86 in the backing plate 80.

Figure 6:
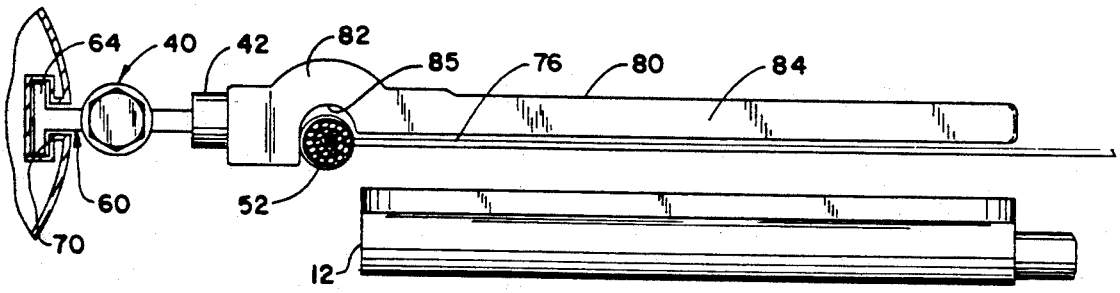
FIG. 6 is a top view illustrating one possible way in which the fitting can be mounted to a mast.

As seen in FIG. 6, the backing plate 80 is connected to the joint member 40, and the joint member 40 is connected to the slide member 60, whereby the slide 64 can be positioned in the guide track 70 in the mast. The bolt rope 52 is then positioned in the arcuate recess 85 so that the sail 76 will be positioned between the planar face of the backing plate 80 and the housing 12. With respect to the arrangement illustrated in FIG. 6, the positioning of the fitting at the appropriate place on the sail and the securing of the backing plate 80 to the housing 12 can be carried out in a manner similar to that described above.

It will be seen from FIG. 6 that the use of the alternative backing plate 80 permits the sail 76 to be positioned substantially on the center line of the boat while the batten 75 is offset slightly to one side of the center line.

Based on the foregoing description, it can be readily appreciated that there are several advantages associated with the compression adjustment fitting 10 according to the preferred embodiments of the present invention. For example, as was mentioned above, the compression adjustment fitting 10 can be positioned on the port side of the sail as well as the starboard side of the sail, thereby resulting in a highly versatile and useful fitting. A person in search of a device for adjusting the compression in the sail battens of a sailboat need not be concerned with which side of the sail the battens are mounted on and whether a particular device is compatible with such a mounting. Likewise, a person need not worry whether a particular device must be modified in structure to be usable in conjunction with a particular mounting of the battens.

As was also mentioned above, the symmetrical nature of the housing 12 with respect to a plane that contains the longitudinal midpoint of the housing and that is substantially perpendicular to the open side of the housing helps contribute to the aforementioned versatility. It should be understood, however, that such symmetry need not pertain to the arrangement of the holes 13 in the flanges 19 of the housing 12 nor to the arrangement of the holes 33 in the backing plate.

The fitting 10 in accordance with the present invention can be used on the luff end or the leech end of the sail, further increasing its usefulness. Also, when mounted on the luff end of the sail, it is possible to mount the fitting such that either the sail or the batten is substantially aligned with the center line of the boat. Thus, the specific characteristics of a particular boat can be taken into account. If a particular boat is better suited to being sailed with the main sail aligned with the center line of the boat, the fitting 10 of the present invention permits the sailboat to be set up to take advantage of that characteristic.

The fitting 10 according to the present invention is also highly useful because of the ease with which the compression in the batten can be adjusted. Through use of a simple socket wrench and possibly an extension, the compression in the batten can be readily adjusted from outside the fitting. That is, it is not necessary to disassemble the fitting in any way in order to vary the compression in the batten. Thus, the compressor in the battens can be readily adjusted while under sail, thereby permitting maximization of the performance of the boat. Further, the compression in the batten can be adjusted while sailing on either tack.

As an alternative to the use of a socket wrench, it would even be possible to utilize a screwdriver to adjust the compression in the batten 75 if the head 23 on the adjustment screw 22 were appropriately modified.

As was mentioned briefly above, the fitting 10 in accordance with the present invention is also readily usable in conjunction with battens of different shapes. One need only select the housing 12 having the appropriate batten receptacle shape, and possibly a joint member which is able to fit therein, in order to adapt the fitting 10 for use on all sailboats employing battens.

It is also to be noted that the overall configuration of the fitting 10, and more particularly the arrangement of the batten receptacle 14, is such that the batten 75 is permitted to remain very close to the sail. Thus, excessive force and wear is not applied to the sail and the batten pocket. Moreover, the compressive force applied to the batten by the adjustment assembly tends to be more parallel to the sail than would be the case if the fitting were designed so that the batten receptacle forced the batten away from the sail.

The fitting 10 according to the present invention is also advantageous with respect to its ease of installation and its relative simplicity of construction. By simply removing the clevis pin 47 and the compression adjustment assembly, the batten 75 can be easily pulled out of the forward end 78 of the housing 12.

The lock nut 28 and its ability to avoid rotation as a result of the shape of the receptacle 16 helps maintain the compression in the batten 75. It is unlikely, therefore, that the compressive force applied to the batten will charge while under sail.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others and equivalents employed herein without departing from the spirit of the present invention. Accordingly it is expressly intended that all such variations, changes and equivalents which fall within the spirit and scope of the present invention as defined in the claims, be embraced thereby.

What is claimed is:

1. A sail batten compression adjustment fitting for use on a sailboat to adjust the compression in a batten positioned in a pocket on a sail of a sailboat, comprising:

a housing having a batten receptacle and a compression adjustment assembly receptacle that is separate from the batten receptacle, said batten receptacle and said compression adjustment assembly receptacle extending the length of the housing and being open at opposite ends of the housing; and a compression adjustment assembly adapted to be positioned in the compression adjustment assembly receptacle, said compression adjustment assembly including an adjustment screw, a lock nut and a tubular traveler, said lock nut being adapted to threadably engage the adjustment screw and said tubular traveler being adapted to encircle and freely move along the adjustment screw, said traveler having a batten contacting portion extending therefrom that is adapted to extend into the batten receptacle to contact the batten so that a compressive force can be applied to the batten and can be adjusted through rotation of the adjustment screw and longitudinal movement of the lock nut along the adjustment screw.

2. The sail batten compression adjustment fitting according to claim 1, wherein said batten receptacle opens to one side of the housing, said one side of the housing lying substantially in a first plane, said housing being substantially symmetrical about a plane which passes through a longitudinal midpoint of the housing and which is perpendicular to the first plane.

3. The sail batten compression adjustment fitting according to claim 1, wherein said batten receptacle opens to one side of the housing, said batten receptacle and said compression adjustment receptacle being positioned above one another when the one side of the housing is positioned against a vertically disposed sail.

4. The sail batten compression adjustment fitting according to claim 1, including means for preventing rotation of the lock nut in the compression adjustment assembly receptacle.

5. The sail batten compression adjustment fitting according to claim 4, wherein said means for preventing rotation of the lock nut includes the compression adjustment assembly receptacle having a cross-sectional shape that prevents the lock nut from rotating

6. The sail batten compression adjustment fitting according to claim 1, including a flanged ferrule positioned between a head of the adjustment screw and an end of the housing to help ensure that the head of the adjustment screw remains exterior to the compression adjustment assembly receptacle so as to be accessible for adjustment purposes.

7. The compression adjustment fitting according to claim 1, including a backing plate that is substantially flat along its entire length, said backing plate being adapted to be connected to the housing with a portion of a sail positioned between the housing and the backing plate.

8. The compression adjustment fitting according to claim 1, including a backing plate that is substantially flat for a portion of its length, said backing plate having a portion adjacent one end thereof that is curved out of the plane of the flat portion so as to define an arcuate recess in one side of the backing plate for receiving a bolt rope of the sail, said backing plate being adapted to be connected to the housing with a portion of the sail positioned between the housing and the backing plate.

9. A compression adjustment fitting for use in adjusting the compression of a sail batten, comprising:

a housing having batten receiving means for receiving a batten and compression adjustment receiving means for receiving a compression adjustment assembly, said batten receiving means opening to one side of the housing and to opposite ends of the housing, said housing being substantially symmetrical about a plane which passes through a point midway between said opposite ends and which is substantially perpendicular to said one side of the housing; and a compression adjustment assembly adapted to be received in the compression adjustment receiving means for adjusting the compression in a batten received in the batten receiving means.

10. The compression adjustment fitting according to claim 9, wherein said compression adjustment receiving means includes a compression adjustment assembly receptacle extending the length of the housing and open at both ends of the housing, said batten receiving means including a batten receptacle separate from the compression adjustment receptacle, said compression adjustment assembly including an adjustment screw, a lock nut adapted to threadably engage the adjustment screw and a tubular traveler adapted to encircle and freely move along the adjustment screw.

11. The compression adjustment fitting according to claim 10, wherein said traveler has a batten contacting portion extending therefrom that is adapted to extend into the batten receptacle to contact an end of a batten, said traveler being positioned between the lock nut and a head of the adjustment screw.

12. The sail batten compression adjustment fitting according to claim 10, wherein said batten receptacle and said compression adjustment assembly receptacle are positioned above one another when the one side of the housing is positioned against a vertically disposed sail.

13. The sail batten compression adjustment fitting according to claim 10, including means for preventing the lock nut from rotating within the compression adjustment assembly receptacle, said means for preventing rotation of the lock nut including the compression adjustment assembly receptacle having a cross-sectional shape that prevents the lock nut from rotating.

14. The compression adjustment fitting according to claim 9, including a substantially flat backing plate adapted to be positioned in confronting relation to the one side of the housing with a portion of a sail positioned therebetween, said backing plate being adapted to be connected to the housing.

15. The compression adjustment fitting according to claim 9, including a backing plate that is substantially flat along a portion of its length, said backing plate having a portion adjacent one end thereof that is curved out of the plane of the flat portion so as to define an arcuate recess in one side of the backing plate for receiving a bolt rope of a sail, said backing plate being adapted to be connected to the housing with a portion of the sail positioned between the housing and the backing plate.

16. The compression adjustment fitting according to claim 9, wherein said batten receiving means includes a batten receptacle having a cross-sectional shape that is round so as to be capable of receiving a round batten.

17. The compression adjustment fitting according to claim 9, wherein said batten receiving means includes a batten receptacle having a cross-sectional shape that is square so as to be capable of receiving a square batten.

18. The compression adjustment fitting according to claim 9, wherein said batten receiving means includes a batten receptacle having a cross-sectional shape that is rectangular with two sides shorter than the others so as to be capable of receiving a flat rectangular batten.

19. A compression adjustment fitting for adjusting the compression in a sail batten, comprising:

a housing having a batten receptacle formed therein for receiving a batten, and an adjustment assembly receptacle formed therein, said batten receptacle and said adjustment assembly receptacle having longitudinal axes offset with respect to one another;

batten engaging means positioned in the housing for engaging a batten located in the batten receptacle; and adjusting means positioned in the adjustment assembly receptacle and accessible from outside the housing and associated with the batten engaging means for adjusting the position of the batten engaging means within the housing to thereby permit the compression in a batten positioned in the batten receptacle to be easily adjusted from outside the housing through operation of the adjusting means.

20. The compression adjustment fitting according to claim 19, wherein said adjusting means includes an adjustment screw and a lock nut adapted to threadably engage the adjustment screw, said batten engaging means including a tubular traveler that is adapted to encircle and move freely along the adjustment screw and to be positioned between the lock nut and a head of the adjustment screw.

21. The compression adjustment fitting according to claim 20, wherein said batten receptacle extends along the length of the housing and opens at opposite ends of the housing and at one side of the housing, said one side of the housing lying in a first plane, said housing being substantially symmetrical about a plane which contains a longitudinal midpoint of the housing and which is substantially perpendicular to said first plane.

22. The sail batten compression adjustment fitting according to claim 19, including an articulating link that is adapted to be connected to a slide so that the fitting can be connected to a mast, said articulating link being connected to a link holder that is configured to be positioned in one end of the batten receptacle, said link holder having an arcuate recess formed in one side thereof for receiving a bolt rope of a sail.

23. The sail batten compression adjustment fitting according to claim 19, wherein said batten receptacle opens to one side of the housing for substantially its entire length.

* * * * *

UNITED STATES PATENT AND TRADEMARK OFFICE

CERTIFICATE OF CORRECTION

PATENT NO. : 5,065,686

DATED : November 19, 1991

INVENTOR(S) : Lewis R. Foster

It is certified that error appears in the above-identified patent and that said Letters Patent is hereby corrected as shown below:

Column 1, line 13, delete "or" and insert therefor --on--.

Column 3, line 45, delete "batter" and insert therefor --batten--.

Column 5, line 66, delete "10".

Column 9, line 13, delete "compressor" and insert therefor --compression--.

Column 9, line 49, delete "charge" and insert therefor --change--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*